US009229372B2

(12) United States Patent
Yoshida et al.

(10) Patent No.: US 9,229,372 B2
(45) Date of Patent: Jan. 5, 2016

(54) DEVELOPING DEVICE, PROCESS CARTRIDGE, AND IMAGE FORMING APPARATUS

(71) Applicants: Tomofumi Yoshida, Osaka (JP); Takafumi Miyazaki, Osaka (JP); Yasuhide Ohkubo, Osaka (JP); Yuusuke Furuichi, Osaka (JP); Rie Mitani, Hyogo (JP)

(72) Inventors: Tomofumi Yoshida, Osaka (JP); Takafumi Miyazaki, Osaka (JP); Yasuhide Ohkubo, Osaka (JP); Yuusuke Furuichi, Osaka (JP); Rie Mitani, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/512,751

(22) Filed: Oct. 13, 2014

(65) Prior Publication Data

US 2015/0132026 A1 May 14, 2015

(30) Foreign Application Priority Data

Nov. 8, 2013 (JP) ..... 2013-232007

(51) Int. Cl.
*G03G 15/08* (2006.01)

(52) U.S. Cl.
CPC ..... *G03G 15/0891* (2013.01); *G03G 15/0893* (2013.01); *G03G 2215/0838* (2013.01)

(58) Field of Classification Search
CPC ..... G03G 15/0812; G03G 15/0865; G03G 15/0887; G03G 15/0889; G03G 15/0891; G03G 15/0893
USPC ..... 399/254, 255
See application file for complete search history.

(56) References Cited

U.S. PATENT DOCUMENTS

| | | | | |
|---|---|---|---|---|
| 5,794,109 | A * | 8/1998 | Ota et al. | 399/286 |
| 2006/0133843 | A1* | 6/2006 | Sugaya | 399/82 |
| 2008/0145108 | A1 | 6/2008 | Yoshida et al. | |
| 2008/0145119 | A1 | 6/2008 | Tatsumi et al. | |
| 2008/0181677 | A1* | 7/2008 | Sakai | 399/277 |
| 2008/0279586 | A1 | 11/2008 | Tatsumi et al. | |
| 2009/0169246 | A1 | 7/2009 | Ooyoshi et al. | |
| 2009/0169265 | A1 | 7/2009 | Yoshida et al. | |
| 2011/0052255 | A1 | 3/2011 | Yoshida et al. | |

(Continued)

FOREIGN PATENT DOCUMENTS

| | | |
|---|---|---|
| JP | 2006-259343 | 9/2006 |
| JP | 2008-009022 | 1/2008 |

(Continued)

*Primary Examiner* — David Gray
*Assistant Examiner* — Thomas Giampaolo, II
(74) *Attorney, Agent, or Firm* — Oblon, McClelland, Maier & Neustadt, L.L.P.

(57) ABSTRACT

A developing device is provided. The developing device includes a developer carrier, a regulator, a first developer storing chamber, a plurality of conveyers disposed within the first developer storing chamber, a second developer storing chamber in communication with the first developer storing chamber, and a supply member disposed within the second developer storing chamber. The developer carrier carries developer on its surface and supplies developer to a latent image carrier carrying a latent image. The regulator regulates the thickness of developer on the surface of the developer carrier. The first developer storing chamber stores developer separated from the developer carrier by the regulator and is to be supplied with fresh developer. Each of the plurality of conveyers coveys developer in a different conveyance direction. The second developer storing chamber is to be supplied with developer from the first developer storing chamber. The supply member supplies developer to the developer carrier.

16 Claims, 7 Drawing Sheets

(56) References Cited

U.S. PATENT DOCUMENTS

| | | | |
|---|---|---|---|
| 2012/0189327 | A1 | 7/2012 | Kubota et al. |
| 2013/0058670 | A1 | 3/2013 | Nakatake et al. |
| 2013/0136465 | A1 | 5/2013 | Yoshida et al. |
| 2013/0183065 | A1 | 7/2013 | Nakamura et al. |
| 2013/0236217 | A1 | 9/2013 | Nagatomo et al. |

FOREIGN PATENT DOCUMENTS

| | | |
|---|---|---|
| JP | 2009-282259 | 12/2009 |
| JP | 2012-159630 | 8/2012 |

* cited by examiner

DEVELOPING DEVICE, PROCESS CARTRIDGE, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-232007, filed on Nov. 8, 2013, in the Japan Patent Office, the entire disclosure of which is hereby incorporated by reference herein.

BACKGROUND

1. Technical Field

The present disclosure relates to a developing device for use in image forming apparatuses such as copier, printer, and facsimile machine; and a process cartridge and an image forming apparatus using the developing device.

2. Description of the Related Art

Image forming apparatus, such as copier, printer, facsimile machine, and combined machine thereof, generally includes a developing device that supplies developer to a latent image carrier such as photosensitive drum. The developing device generally includes a developer carrier, such as developing roller, that supplies developer to the latent image carrier by contact therewith; a supply member, such as supply roller, that supplies developer to the developer carrier; and a regulator, such as regulating blade or regulating roller, that regulates the thickness of the developer deposited on the surface of the developer carrier. As the supply member and the developer carrier supply the developer stored in the developing device to the latent image carrier, a latent image on the latent image carrier is developed.

SUMMARY

In accordance with some embodiments of the present invention, a developing device is provided. The developing device includes a developer carrier, a regulator, a first developer storing chamber, a plurality of conveyers disposed within the first developer storing chamber, a second developer storing chamber in communication with the first developer storing chamber, and a supply member disposed within the second developer storing chamber. The developer carrier carries developer on its surface and supplies developer to a latent image carrier carrying a latent image. The regulator regulates the thickness of developer on the surface of the developer carrier. The first developer storing chamber stores developer separated from the developer carrier by the regulator and is to be supplied with fresh developer. Each of the plurality of conveyers coveys developer in a different conveyance direction. The second developer storing chamber is to be supplied with developer from the first developer storing chamber. The supply member supplies developer to the developer carrier.

In accordance with some embodiments of the present invention, a process cartridge is provided. The process cartridge includes a latent image carrier and the above-described developing device.

In accordance with some embodiments of the present invention, an image forming apparatus is provided. The image forming apparatus includes, a latent image carrier, the above-described developing device, a transfer device, and a fixing device. The transfer device transfers a toner image onto a recording medium. Here, the toner image is formed by developing the latent image by the developing device. The fixing device fixes the toner image on the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
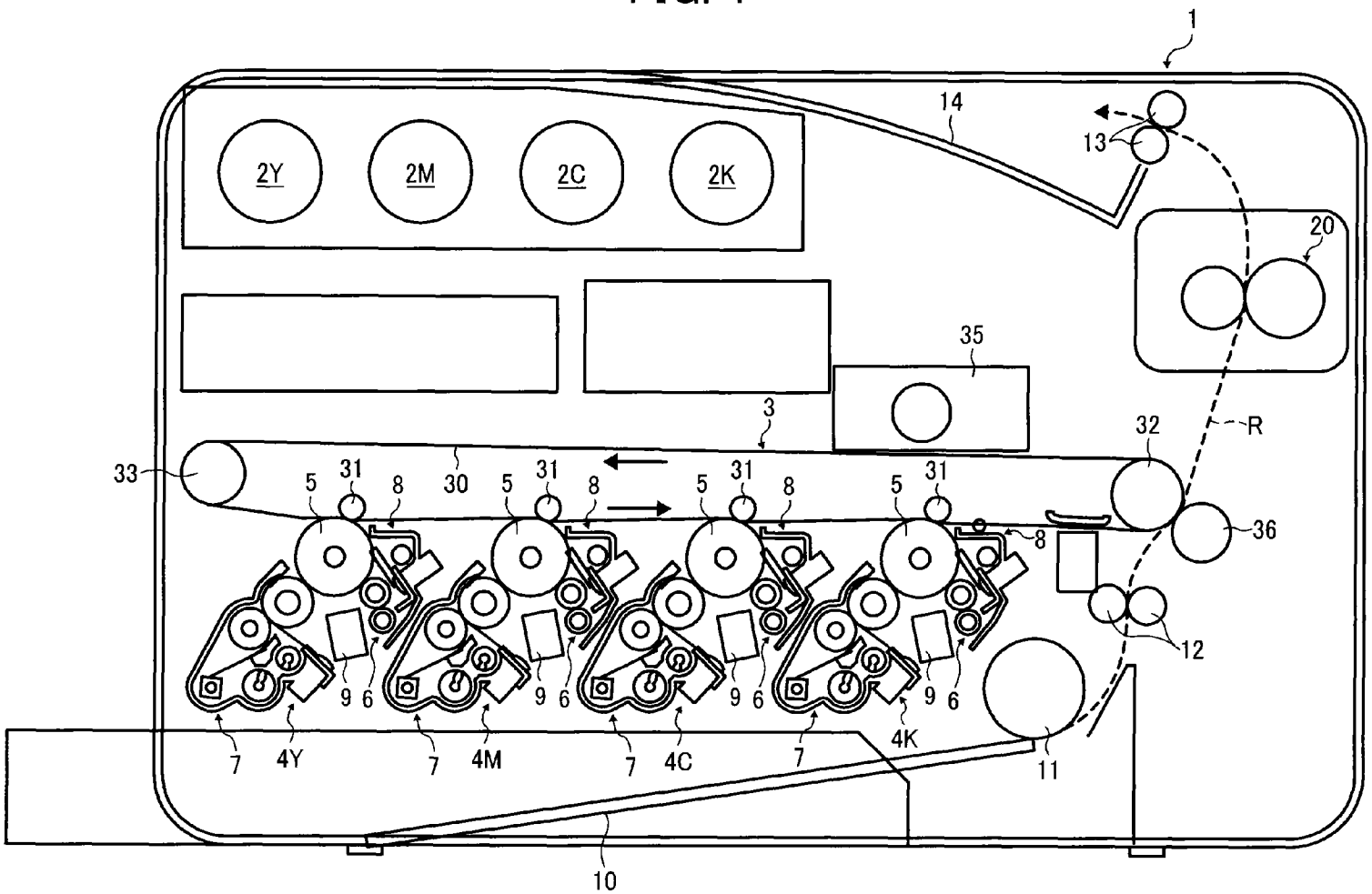
FIG. 1 is a schematic view of an image forming apparatus according to an embodiment of the present invention.

One objective of the present invention is to provide a developing device which reliably prevents the occurrence of defective image, such as blurred image.

In accordance with some embodiments of the invention, developer separated from the developer carrier by the regulator, i.e., non-fresh developer, is resupplied to the developer carrier through the first developer storing chamber, the second developer storing chamber, and the supply member. By circulating developer within the developing device, forming the first circulation path, the developer is prevented from retaining at a certain portion, preventing local deterioration of the developer. A plurality of conveyers provided within the first developer storing chamber convey developer in different conveyance directions to circulate the developer within the first developer storing chamber, forming the second circulation path. Thus, non-fresh developer and fresh developer can be mixed together well. Since the well-mixed developer is supplied to the second developer storing chamber, a situation where localized non-fresh developer is resupplied to the developer carrier can be avoided. Accordingly, local deterioration of the toner particles and production of defective image such as blurred image can be prevented.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

An image forming apparatus according to an embodiment of the present invention is described below with reference to FIG. 1. An image forming apparatus 1 illustrated in FIG. 1 is a color laser printer. An intermediate transfer belt 30 is disposed approximately at the center part of the printer in a height direction. Four process cartridges 4Y, 4M, 4C, and 4K are disposed below the intermediate transfer belt 30. The process cartridges 4Y, 4M, 4C, and 4K have the same configuration except for storing developers with different colors of yellow (Y), magenta (M), cyan (C), and black (K), respectively, corresponding to the color separation components of a color image. Descriptions of the present embodiment are made with a case in which one-component developer consisting of toner only is used, however, two-component developer consisting of toner and carrier may also be used.

Each of the process cartridges 4Y, 4M, 4C, and 4K includes a photoreceptor 5 in a drum-like shape serving as a latent image carrier, a charger 6 to charge a surface of the photoreceptor 5, a developing device 7 to supply toner to a surface of the photoreceptor 5, a cleaner 8 to clean a surface of the photoreceptor 5, and an irradiator 9 to irradiate a surface of the photoreceptor 5. In the present embodiment, an LED unit is employed as the irradiator 9.

A transfer device 3 is disposed above the process cartridges 4Y, 4M, 4C, and 4K. The transfer device 3 includes the intermediate transfer belt 30 serving as an intermediate transfer medium, four primary transfer rollers 31 serving as primary transfer means, a secondary transfer roller 36 serving as secondary transfer means, a secondary transfer backup roller 32, and a belt cleaner 35.

The intermediate transfer belt 30 is in the form of an endless belt and stretched taut with the secondary transfer backup roller 32 and a roller 33. The intermediate transfer belt 30 rotates in the direction indicated by arrow in FIG. 1 as the secondary transfer backup roller 32 is driven to rotate.

Each of the four primary transfer rollers 31 and the corresponding photoreceptor 5 is sandwiching the intermediate transfer belt 30 to form a primary transfer nip. Each of the primary transfer rollers 31 is connected to a power source which applies a predetermined direct current voltage (DC) and/or alternating current voltage (AC) thereto.

The secondary transfer roller 36 and the secondary transfer backup roller 32 is sandwiching the intermediate transfer belt 30 to form a secondary transfer nip. The secondary transfer roller 36 is connected to a power source which applies a predetermined direct current voltage (DC) and/or alternating current voltage (AC) thereto.

The belt cleaner 35 includes a cleaning brush and a cleaning blade both disposed in contact with the intermediate transfer belt 30. The belt cleaner 35 is connected to a waster toner container with a waste toner transport hose.

Four toner cartridges 2Y, 2M, 2C, and 2K to store supplementary fresh toner are detachably mounted to an upper part of the printer. A supply path is provided between each of the toner cartridges 2Y, 2M, 2C, and 2K and each of the developing devices 7 to supply fresh toner from each of the toner cartridges 2Y, 2M, 2C, and 2K to each of the developing devices 7.

At a lower part of the main body of the printer, a paper feed tray 10 to store paper sheets, serving as recording media, and a paper feed roller 11 to feed the paper sheets from the paper feed tray 10 are provided. Other than normal paper sheets, sheets of thick paper, thin paper, coated paper, art paper, or tracing paper, postcards, envelopes, OHP sheets, etc., can be used as the recording media. It is possible to further provide a manual paper feed mechanism.

Inside the main body of the printer, a conveyance path R is provided to convey paper sheet from the paper feed tray 10 to the outside of the printer via the secondary transfer nip. On the conveyance path R, a pair of registration rollers 12 is provided upstream from the secondary transfer roller 36 relative to the direction of conveyance of paper sheet. The pair of registration rollers 12 conveys paper sheet to the secondary transfer nip at the right timing.

A fixing device 20 to fix an unfixed toner image on a paper sheet is provided downstream from the secondary transfer roller 36 relative to the direction of conveyance of paper sheet. A pair of discharge rollers 13 to discharge paper sheet to the outside of the printer is provided on the conveyance path R downstream from the fixing device 20 relative to the direction of conveyance of paper sheet. On an upper surface of the main body of the printer, a discharge tray 14 is provided to stack paper sheets discharged from the printer.

Basic operation of this printer is explained below with reference to FIG. 1.

At the beginning of an imaging operation, each of the photoreceptors 5 in the process cartridges 4Y, 4M, 4C, or 4K is driven to rotate clockwise in FIG. 1 by a driving device. A surface of each of the photoreceptors 5 is then uniformly charged to a predetermined polarity by each of the chargers 6. The charged surface of the photoreceptor 5 is irradiated with laser light emitted from the irradiator 9 so that an electrostatic latent image is formed on the surface of the photoreceptor 5. The laser light contains single-color image information of yellow, magenta, cyan, or black that is separated from full-color image information. The electrostatic latent image formed on each of the photoreceptors 5 is supplied with toner from each of the developing devices 7 and developed into a toner image that is visible.

On the other hand, the secondary transfer backup roller 32 is driven to rotate counterclockwise in FIG. 1 so that the intermediate transfer belt 30 is driven to rotate in the direction indicated by arrow in FIG. 1. Each of the primary transfer rollers 31 is applied with a constant-voltage-controlled or constant-current-controlled voltage having the opposite polarity to toner so that a transfer electric field is formed in the primary transfer nip defined between each of the primary transfer rollers 31 and each of the photoreceptors 5.

Upon reaching the primary transfer nips as the photoreceptors 5 rotate, the toner images on the respective photoreceptors 5 are sequentially transferred onto the intermediate transfer belt 30 and superimposed on one another by action of the transfer electric fields formed in the primary transfer nips. Thus, a full-color composite toner image is formed on a surface of the intermediate transfer belt 30. Residual toner particles remaining on the photoreceptors 5 without being transferred onto the intermediate transfer belt 30 are removed by the cleaners 8. The surface of each of the photoreceptors 5 is neutralized by a neutralizer to initialize the surface potential.

At a lower part of the printer, the paper feed roller 11 starts rotating to feed a paper sheet from the paper feed tray 10 to the conveyance path R. The conveyance of the paper sheet is once stopped by the pair of registration rollers 12.

The pair of registration rollers 12 starts rotating at a predetermined timing so that the paper sheet is conveyed to the secondary transfer nip in synchronization with an entry of the full-color composite toner image on the intermediate transfer belt 30 into the secondary transfer nip. The secondary transfer roller 36 is applied with a transfer voltage having the opposite polarity to the full-color composite toner image on the intermediate transfer belt 30 so that a transfer electric field is formed in the secondary transfer nip. The full-color composite toner image is transferred from the intermediate transfer belt 30 onto the paper sheet by action of the transfer electric field. Residual toner particles remaining on the intermediate transfer belt 30 without being transferred onto the paper sheet are removed by the belt cleaner 35 and collected in the waste toner storage.

The paper sheet is then conveyed to the fixing device 20 and the full-color composite toner image is fixed on the paper sheet in the fixing device 20. The paper sheet having the fixed full-color composite toner image is discharged onto the discharge tray 14 by rotation of the discharge rollers 13.

In the above-described embodiment, all of the four process cartridges 4Y, 4M, 4C, and 4K are brought into operation to form full-color images. According to another embodiment, only one of the four process cartridges 4Y, 4M, 4C, and 4K is brought into operation to form single-color images. According to another embodiment, two or three of the four process cartridges 4Y, 4M, 4C, and 4K are brought into operation to form two-color or three-color toner images, respectively.

In the present embodiment, the four process cartridges 4Y, 4M, 4C, and 4K are disposed below the intermediate transfer belt 30 that is rotatable in the direction indicated by arrow in FIG. 1. In this case, the distance between the primary transfer nip (i.e., the nip formed between the photoreceptor 5 and the primary transfer roller 31) and the secondary transfer nip (i.e., the nip formed between the secondary transfer roller 36 and the secondary transfer backup roller 32) is shorter compared to a case in which the process cartridges are disposed above the intermediate transfer belt 30. Accordingly, the distance that the intermediate transfer belt 30 travels after the primary transfer was completed before the secondary transfer is executed is shorter, which means that the length of the time before the first print is shorter. The photoreceptors 5 keep rotating in synchronization with the rotation of the intermediate transfer belt 30, keeping supplying toner from the photoreceptors 5 to the intermediate transfer belt 30. The shorter travel distance of the intermediate transfer belt 30 suppresses wear of the photoreceptor or consumption of the toner.

The belt cleaner 35 is provided immediately downstream from the secondary transfer nip, i.e., above the intermediate transfer belt 30, as illustrated in FIG. 1. If the process cartridges 4Y, 4M, 4C, and 4K are provided above the intermediate transfer belt 30, the process cartridges 4Y, 4M, 4C, and 4K and the belt cleaner 35 should be arranged next to each other in a horizontal direction, resulting in an increase in the horizontal width of the image forming apparatus. By contrast, when the process cartridges 4Y, 4M, 4C, and 4K are provided below the intermediate transfer belt 30 as illustrated in FIG. 1, the process cartridges 4Y, 4M, 4C, and 4K and the belt cleaner 35 need not be arranged next to each other in a horizontal direction, avoiding an increase in the horizontal width of the image forming apparatus.

Figure 2:
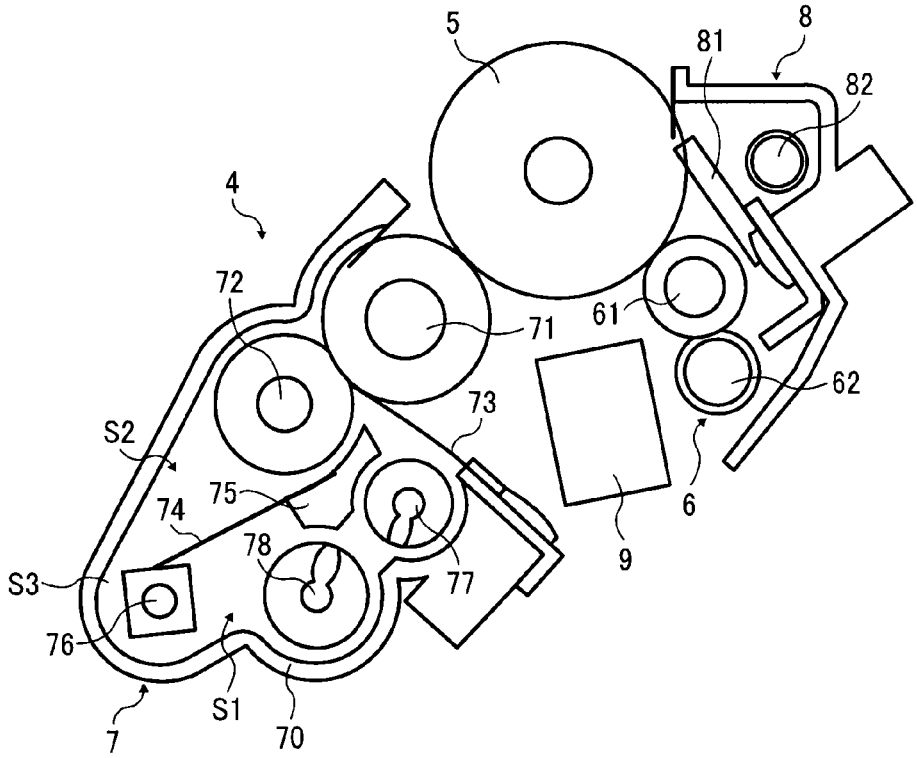
FIG. 2 is a cross-sectional view of the developing device installed in the image forming apparatus illustrated in FIG. 1 perpendicular to the axial direction.

FIG. 2 is a cross sectional view of the process cartridge 4 (hereinafter the additional characters Y, M, C, and K representing the respective colors of yellow, magenta, cyan, and black are omitted for the sake of simplicity). The process cartridge 4 includes the photoreceptor 5, the charger 6, the developing device 7, the cleaner 8, and the irradiator 9. The charger 6 includes a charging member 61 to charge the photoreceptor 5 by contact therewith and a cleaning member 62 to clean the charging member 61. The cleaner 8 includes a cleaning member 81 to remove developer (toner) adhered to a surface of the photoreceptor 5 and a waste toner conveying member 82 to convey waste toner particles removed by the cleaning member 81.

The developing device 7 includes a housing 70, a developing roller 71 serving as a developer carrier to carry toner, a supply roller 72 serving as a supply member to supply toner to the developing roller 71, and a regulating blade 73 serving as a regulator to regulate the thickness of toner carried on the developing roller 71. The developer carrier is not limited to the developing roller 71 and may be a developing belt. The regulator is not limited to the regulating blade 73 and may be a regulating roller.

The space inside the housing 70 is divided by a divider 74 to form a mixing chamber S1 serving as a first developer storing chamber and a supply chamber S2 serving as a second developer storing chamber. The mixing chamber S1 is in communication with the supply chamber S2 through a communication path S3. Referring to FIG. 2, the mixing chamber S1 is disposed below the supply chamber S2 and the lowermost part of the supply chamber S2 is communicated with the mixing chamber S1 through the communication path S3.

The divider 74 is comprised of a flexible thin plate made of, for example, a metal or a resin. The divider 74 is disposed in parallel with the developing roller 71 and the supply roller 72 in an axial direction and has the same axial dimension as the developing roller 71 and the supply roller 72. The upper end of the divider 74 is fixed to a retention member 75 disposed close to the supply roller 72 (i.e., immediately below the supply roller 72 in FIG. 2). The divider 74 extends obliquely downward from the fixed point.

Inside the mixing chamber S1, a drawing member 76 and first and second conveyance screws 77 and 78 serving as a plurality of conveyers are provided. The drawing member 76 draws toner from the mixing chamber S1 and supplies it to the supply chamber S2 through the communication path S3. The drawing member 76 has a rotation axis parallel to the developing roller 71 and the supply roller 72. The drawing member 76 draws toner by rotating on the rotation axis. The drawing member 76 has the same axial dimension as the developing roller 71 and the divider 74. The outer periphery of the drawing member 76 has a cross-sectional shape such that the distance from the rotation axis varies along the circumferential direction. The cross-sectional shape may be, for example, a polygon (e.g., regular tetragon, regular triangle, regular hexagon) or an ellipse. In the present embodiment, the drawing member 76 is comprised of a cuboid, the cross-sectional shape of the outer periphery of which is regular tetragon. The lower end of the divider 74 is contacting the all parts of drawing member 76 in an axial direction from an upper side.

Figure 3:
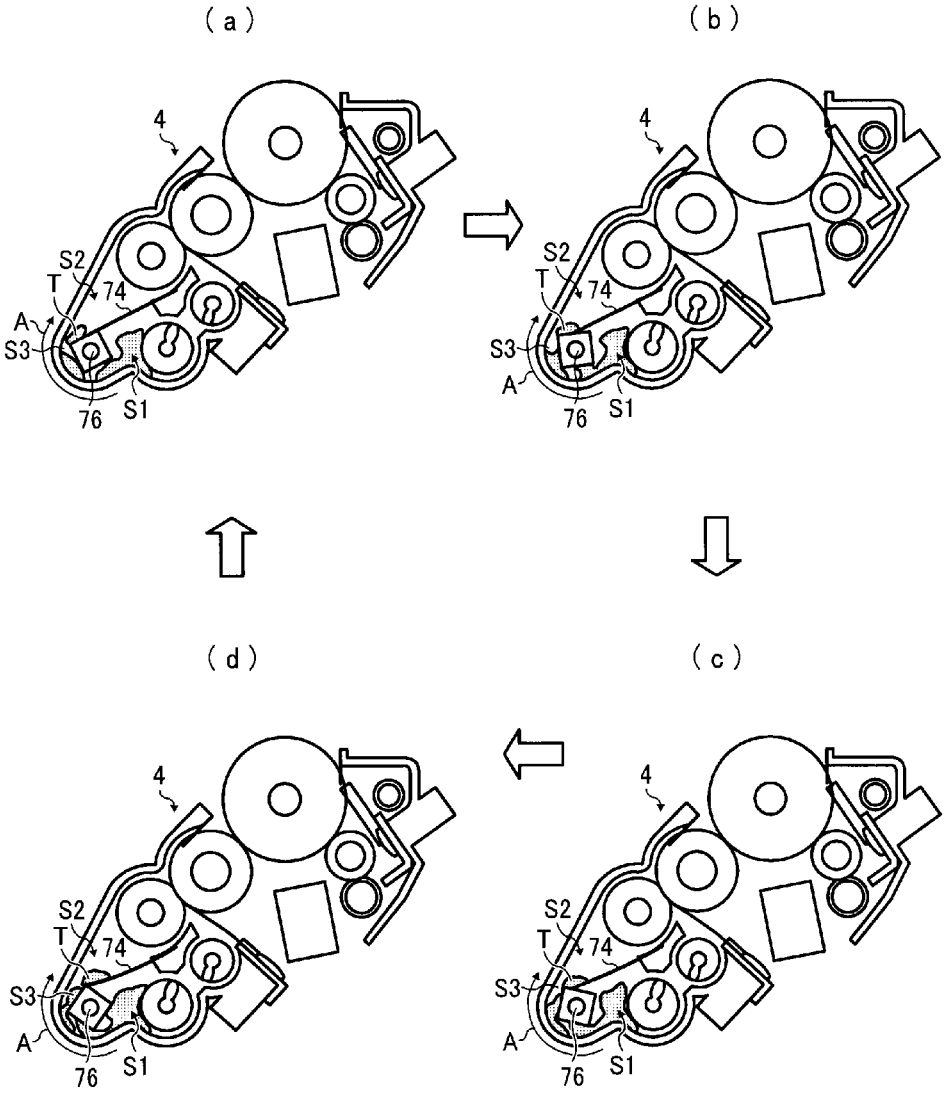
FIG. 3 is a schematic view showing how the drawing member draws toner in the developing device.

How the drawing member 76 draws toner is explained with reference to FIG. 3. As the drawing member 76 rotates in the direction indicated by arrow A, the outer peripheral surface of the drawing member 76 and the inner surface of the housing 70 cooperate to draw toner particles T (represented by dots) upward from the mixing chamber S1 toward the supply chamber S2 through the communication path S3, as shown in the figures (a) to (d). By repeating this operation, toner particles T stored in the mixing chamber S1 are continuously supplied to the supply chamber S2. The drawing member 76 may be rotated either on a constant basis or on command.

While the drawing member 76 is rotating, the lower end of the divider 74 is elastically pressing against the drawing member 76 with the divider 74 slightly bended. Accordingly, the divider 74 is constantly contacting the drawing member 76 even when the drawing member 76 is rotating. Thus, it is possible to avoid a situation where the toner particles T drawn by the drawing member 76 return to the mixing chamber S1 through a gap between the divider 74 and the drawing member 76. Since the divider 74 is extending obliquely downward, the supply chamber S2 is formed into a tapered shape such that its cross section in a horizontal direction becomes gradually smaller downward (toward the communication path S3). Accordingly, even when toner particles stored in the supply chamber S2 fall down by their own weight, they are pushed in the direction that the horizontal width becomes narrower, preventing backward flow of the toner particles from the communication path S3 owing to friction between toner particles. By rotating the drawing member 76 on a constant basis, the toner particles are constantly pushed in from the lowermost part of the mixing chamber S1, more reliably preventing backward flow of the toner particles within the mixing chamber S1.

Each of the first conveyance screw 77 and second conveyance screw 78 has a rotation axis parallel to the developing roller 71. The first conveyance screw 77 is disposed immediately below the regulating position of the regulating blade 73, i.e., the contact point of the developer on the developing roller 71 with the regulating blade 73, in a vertical direction. The lower end of the second conveyance screw 78 is positioned below the lower end of the first conveyance screw 77. The rotation axis of the second conveyance screw 78 is on the side much closer to the communication path S3 (i.e., the left side in FIG. 2) compared to the rotation axis of the first conveyance screw 77. The second conveyance screw 78 has a conveyance ability higher than that of the first conveyance screw 77. In the present embodiment, the second conveyance screw 78 has an outer diameter greater than that of the first conveyance screw 77.

Figure 4:
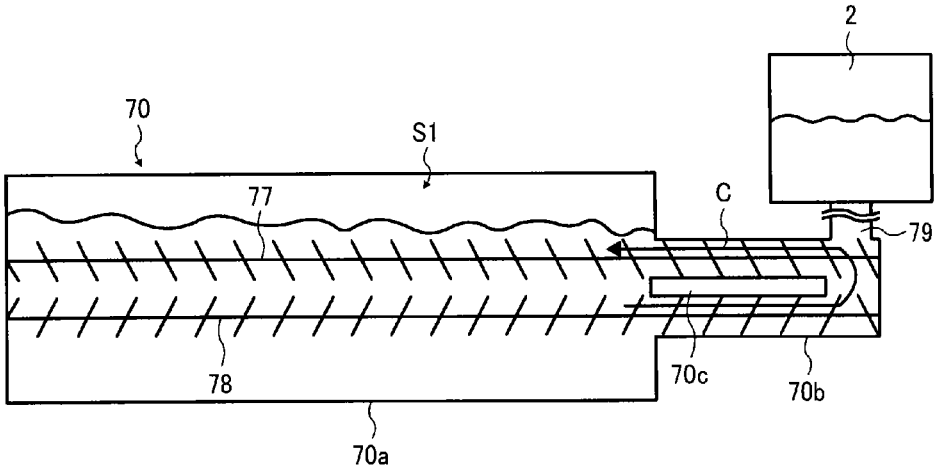
FIG. 4 is a cross-sectional view of the developing device perpendicular to the axial direction in the vicinity of the conveyance screws.

The first conveyance screw 77 and the second conveyance screw 78 convey toner particles in opposite axial directions as rotate. In the present embodiment, as illustrated in FIG. 4, the first conveyance screw 77 conveys toner in one axial direction and the second conveyance screw 78 conveys toner in the opposite axial direction. In the present embodiment, the axial dimension of the conveyance screws 77 and 78 is greater than that of the developing roller 71 and supply roller 72. In the present embodiment, the conveyance screws 77 and 78 are extending in an axial direction projecting from one end of the developing roller 71. The housing 70 includes a main body part 70*a* storing the developing roller 71, etc., and a projecting part 70*b* projecting from the main body part 70*a* in an axial direction to cover the projected parts of the conveyance screws 77 and 78. The second conveyance screw 78, disposed on a lower side, conveys toner in a direction that the toner is pushed in the projecting part 70*b*. The first conveyance screw 77, disposed on an upper side, conveys toner in a direction that the toner is drawn from the projecting part 70*b*. Toner particles accumulated at a lower part of the mixing chamber S1 are pushed in the projecting part 70*b* by the second conveyance screw 78 and drawn from the projecting part 70*b* by the first conveyance screw 77, circulating along a circulation path C as illustrated in FIG. 4.

Figure 5:
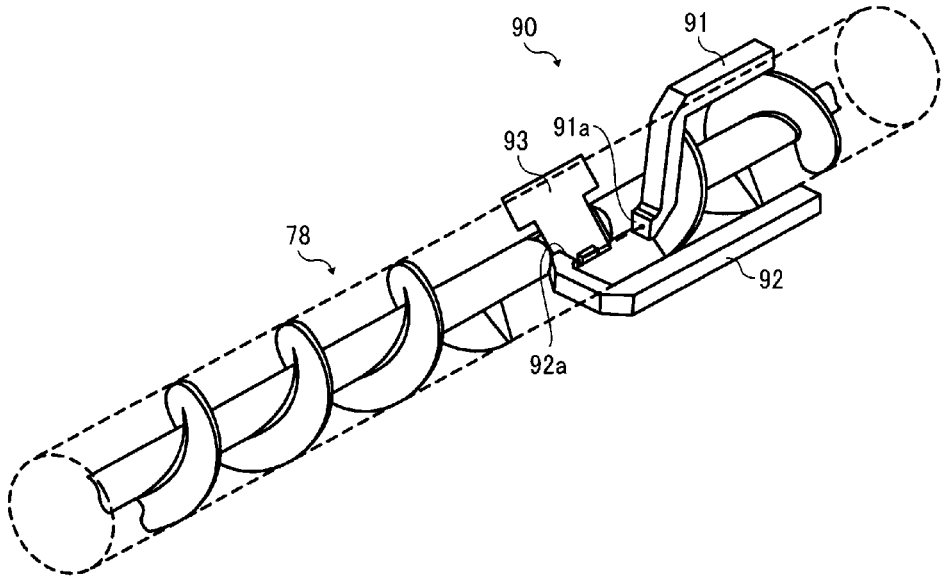
FIG. 5 is a perspective view of the second conveyance screw and the toner detector.

The mixing chamber S1 has a toner detector 90 serving as a developer detector to detect the amount of toner stored in the mixing chamber S1. Referring to FIG. 5, the toner detector 90 includes a first light guiding member 91 and a second light guiding member 92 both fixed to the housing 70, and a cleaning member 93 fixed to a conveyance member (i.e., the second conveyance screw 78 in the present embodiment). One end of the first light guiding member 91 is connected to a light-emitting element and the other end functions as a light-emitting surface 91*a*. One end of the second light guiding member 92 is connected to a light-receiving element and the other end functions as a light-receiving surface 92*a*. The light-emitting surface 91*a* of the first light guiding member 91 and the light-receiving surface 92*a* of the second light guiding member 92 are facing each other in an axial direction.

The cleaning member 93 is comprised of a flexible platy member made of, for example, a PET sheet. The cleaning member 93 rotates along with the second conveyance screw 78. As the cleaning member 93 rotates, the cleaning member 93 slidably contacts the light-emitting surface 91*a* of the first light guiding member 91 and the light-receiving surface 92*a* of the second light guiding member 92 to remove toner particles adhered to the light-emitting surface 91*a* and the light-receiving surface 92*a*. Moreover, as the cleaning member 93 rotates, toner particles accumulated at a lower part of the mixing chamber S1 are scraped up by the cleaning member 93 and allowed to pass through between the light-emitting surface 91*a* and the light-receiving surface 92*a*. While the scraped-up toner particles are passing through between the light-emitting surface 91*a* and the light-receiving surface 92*a*, light emitted from the light-emitting surface 91*a* cannot reach the light-receiving surface 92*a* and the light-receiving element detects no signal. During the rest of such time period, light emitted from the light-emitting surface 91*a* reaches the light-receiving surface 92*a* and the light-receiving element detects a signal. Since the amount of toner scraped up by the cleaning member 93 varies depending on the amount of toner in the mixing chamber S1, the light-receiving time of the light-receiving element also varies. Accordingly, by detecting the light-receiving time of the light-receiving element, the amount of toner in the mixing chamber S1 can be detected.

If the toner detector 90 is provided to a conveyance member disposed immediately below the regulating position of the regulating blade 73 (i.e., the first conveyance screw 77 in the present embodiment), there is a possibility that toner particles having been regulated by the regulating blade 73 fall on the light-emitting surface 91*a* and the light-receiving surface 92*a* to reduce detection accuracy of the toner detector 90. In view of this, the toner detector 90 is preferably provided to the other conveyance member disposed not immediately below the regulating position of the regulating blade 73 (i.e., the second conveyance screw 78 in the present embodiment).

Referring to FIG. 4, the mixing chamber S1 has a fresh toner supply opening 79 through which fresh toner is supplied from the toner cartridge 2 (the additional characters Y, M, C, and K representing the respective colors of yellow, magenta, cyan, and black are omitted for the sake of simplicity). The fresh toner supply opening 79 may be provided on the toner conveyance path formed by the first conveyance screw 77. In the present embodiment illustrated in FIG. 4, the fresh toner supply opening 79 is provided to the projecting part 70*b* of the housing 70 above the axial end part of the first conveyance screw 77. The fresh toner supply opening 79 has opening-closing means such as shutter. The fresh toner supply opening 79 is normally closed but opened when the toner amount detected by the toner detector 90 falls below the standard value. The mixing chamber S1 is thereby filled with fresh toner particles supplied from the toner cartridge 2 through the fresh toner supply opening 79. Alternatively, the fresh toner supply opening 79 may be provided on the toner conveyance path formed by the second conveyance screw 78. The fresh toner supply opening 79 may be also provided to the main body part 70*a* of the housing 70. In this case, the projecting part 70*b* is not provided to the housing 70, and the conveyance screws 77 and 78 are given the same axial dimension as the developing roller 71 to be stored within the main body part 70*a*.

A divider may be partially provided between the first conveyance screw 77 and the second conveyance screw 78. In the present embodiment, a divider 70*c* is provided within the projecting part 70*b* of the housing 70 to divide a part of the space between the conveyance screws 77 and 78 in an axial direction. A communication path is provided on the side of the axial end of the divider 70*c* (i.e., the right side in FIG. 4). Toner particles conveyed by the second conveyance screw 78 are conveyed to the conveyance path formed by the first conveyance screw 77 through this communication path. Alternatively, the divider 70*c* may be provided to the main body part 70*a* of the housing 70. Alternatively, two or more dividers 70*c* may be provided apart from each other in an axial direction. Alternatively, the divider 70*c* may be provided to cover all parts of the main body part 70*a* in an axial direction.

Figure 6:
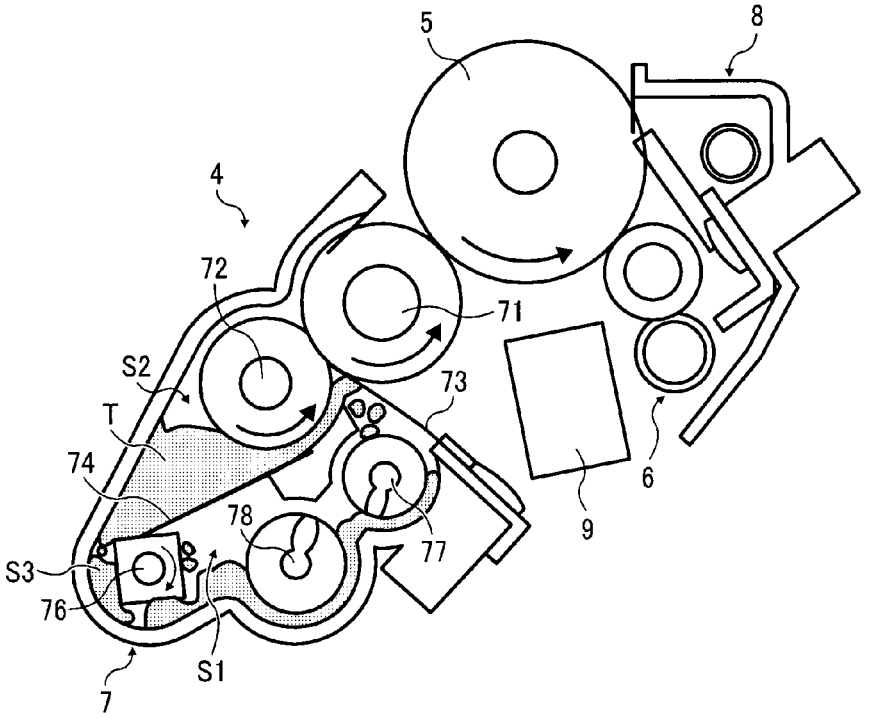
FIG. 6 is a cross-sectional view of the developing device perpendicular to the axial direction, illustrating operation conditions of the developing device.

Operation of the developing device 7 is described below. As an imaging operation is started, the photoreceptor 5, the developing roller 71, and the supply roller 72 each start rotating in the directions indicated by arrows in FIG. 6. The first and second conveyance screws 77 and 78 and the drawing member 76 also start rotating along with them. As the drawing member 76 rotates, toner particles T in the mixing chamber S1 are drawn into the supply chamber S2 through the communication path S3, as illustrated in FIG. 3, accumulating in the supply chamber S2. As the top surface of a lump of toner T reaches the supply roller 72, the toner particles are transferred onto the developing roller 71 via the supply roller 72. Since the supply chamber S2 is equipped with no conveyance member such as screw, the top surface of the lump of toner T becomes roughly horizontal. This makes it possible to supply the toner particles to all parts of the developing roller 71 in an axial direction. Since the upper surface of the divider 74 constituting an inner wall of the supply chamber S2 and an inner surface of the housing 70 which is facing the upper surface of the dividing member 74 are both smooth, toner particles are prevented from retaining on the inner walls of the supply chamber S2.

Among the toner particles carried on the developing roller 71, excessive toner particles are regulated by the regulating blade 73 and collected in the mixing chamber S1. Such non-fresh toner particles regulated by the regulating blade 73 freely fall onto the first conveyance screw 77 disposed immediately below the regulating position. On the other hand, as the opening-closing means of the fresh toner supply opening 79 is opened, fresh toner particles are supplied from the toner cartridge 2 onto the first conveyance screw 77. As the first conveyance screw 77 and second conveyance screw 78 circulate the toner particles within the mixing chamber S1, the non-fresh and fresh toner particles are stirred and mixed. The resulting homogeneously-mixed toner particles are supplied again to the supply chamber S2 by the drawing member 76.

Figure 7:
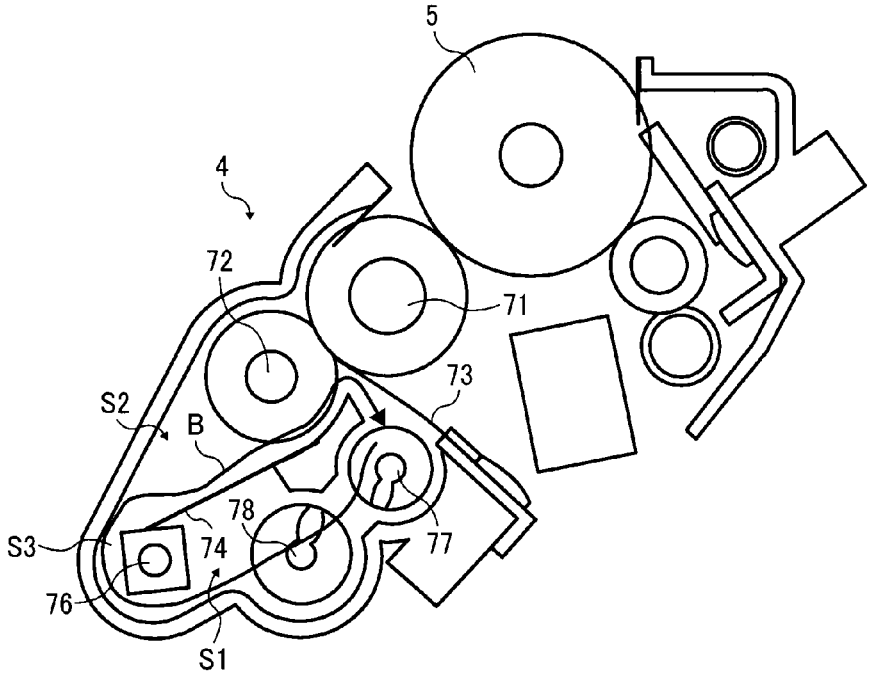
FIG. 7 is a cross-sectional view of the developing device perpendicular to the axial direction, showing the first circulation path.

In the developing device 7, toner particles regulated by the regulating blade 73 freely fall and are collected in the mixing chamber S1. As a result, as illustrated in FIG. 7, a first circulation path B is formed that circulates toner through the mixing chamber S1, communication path S3, supply chamber S2, supply roller 72, developing roller 71, and mixing chamber S1, in this order. By circulating toner particles within the developing device, local deterioration of the toner particles and production of defective image such as blurred image can be prevented. Although one-component developer is likely to cause detachment of external additives or crack of toner particles, resulting in a decrease in fluidity or a shortage in charge, the circulation of toner particles prevents local deterioration of the toner particles.

As the first conveyance screw 77 and second conveyance screw 78 that convey toner particles in opposite axial directions are provided within the mixing chamber S1, a second circulation path C is formed within the mixing chamber S1, as illustrated in FIG. 4. By circulating toner particles within the mixing chamber S1, the toner particles are well mixed in the mixing chamber S1. In particular, as fresh toner particles are supplied from the fresh toner supply opening 79 that is provided on the second circulation path C, the non-fresh and fresh toner particles can be well mixed. As such homogeneously-mixed toner particles are supplied to the supply chamber S2, a situation where localized non-fresh toner particles are resupplied to the developing roller 71 can be avoided, thereby preventing production of defective image such as blurred image which may be caused due to the localization of the non-fresh toner particles.

In a case where the developing device 7 is disposed below the intermediate transfer belt 30 as in the present embodiment, it is necessary to convey developer from downward to upward within the developing device 7. In this case, it is preferable that the lowermost part of the supply chamber S2 be communicated with the mixing chamber S1 through the communication path S3. With such a configuration, toner can be supplied from the lowermost part of the supply chamber S2 through the communication path S3, and the top surface of a lump of toner particles inside the supply chamber S2 can go upward to reach the supply roller 72.

When a gap is formed between the divider 74 and the drawing member 76, there is a possibility that toner particles drawn by the drawing member 76 return to the mixing chamber S1 through the gap between the divider 74 and the drawing member 76 without being supplied to the supply chamber S2, resulting in decrease in toner supply efficiency. Accordingly, it is preferable that the divider 74 is capable of being elastically deformed so as to constantly contact the drawing member 76.

When the second conveyance screw 78, positioned on a lower side, has a conveyance ability higher than that of the first conveyance screw 77, positioned on an upper side, toner particles accumulated at a lower part of the mixing chamber S1 can be stirred effectively. When the first conveyance screw 77 is disposed immediately below the regulating position of the regulating blade 73 in a vertical direction, non-fresh toner particles released from the developing roller 71 at the regulating position fall onto the first conveyance screw 77 that is rotating. Thus, the first conveyance screw 77 immediately starts stirring the toner particles fallen from the developing roller 71 and mixing with toner particles already present in the mixing chamber S1. When fresh toner particles are supplied from the fresh toner supply opening 79 that is provided on the conveyance path of the first conveyance screw 77, mixing of the non-fresh toner particles with fresh toner particles is started. By starting the stirring and mixing of the toner particles at a position immediately downstream from the regulating position of the regulating blade 73, the path between the position where the stirring and mixing starts and the developing roller 71 can be made long. This results in a more uniform mixing of the toner particles.

Figure 8:
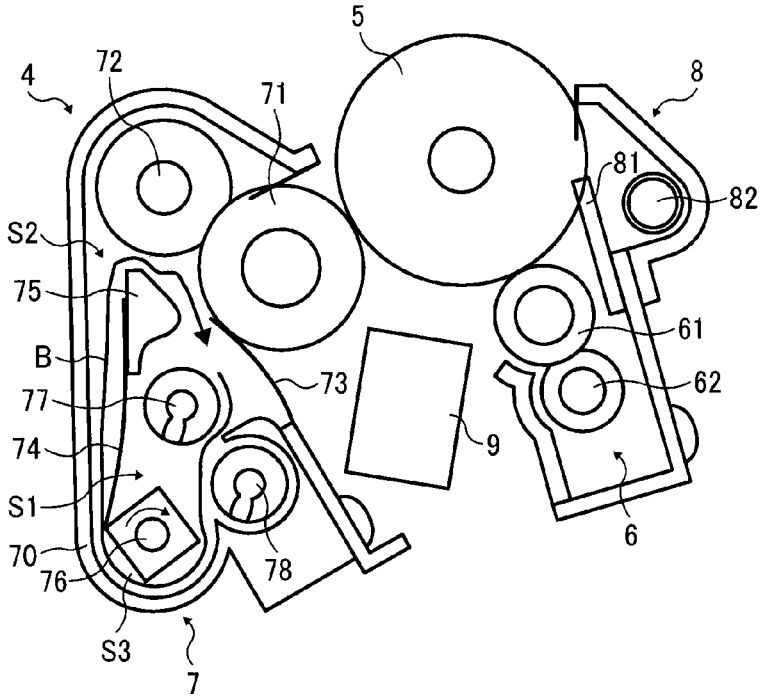
FIG. 8 is a cross-sectional view of the developing device according to another embodiment of the present invention perpendicular to the axial direction.

FIG. 8 is a schematic view of the developing device 7 according to another embodiment. In this embodiment, the supply roller 72 is disposed obliquely upward from the developing roller 71, and the drawing member 76 is disposed obliquely downward from the supply roller 72. Thus, the mixing chamber S1 and supply chamber S2 have a shape relatively long in a vertical direction. As the developing roller 71, supply roller 72, and drawing member 76 rotate, the first circulation path B is formed. As the first conveyance screw 77 and second conveyance screw 78 rotate, the second circulation path C is formed, as illustrated in FIG. 4.

Figure 9:
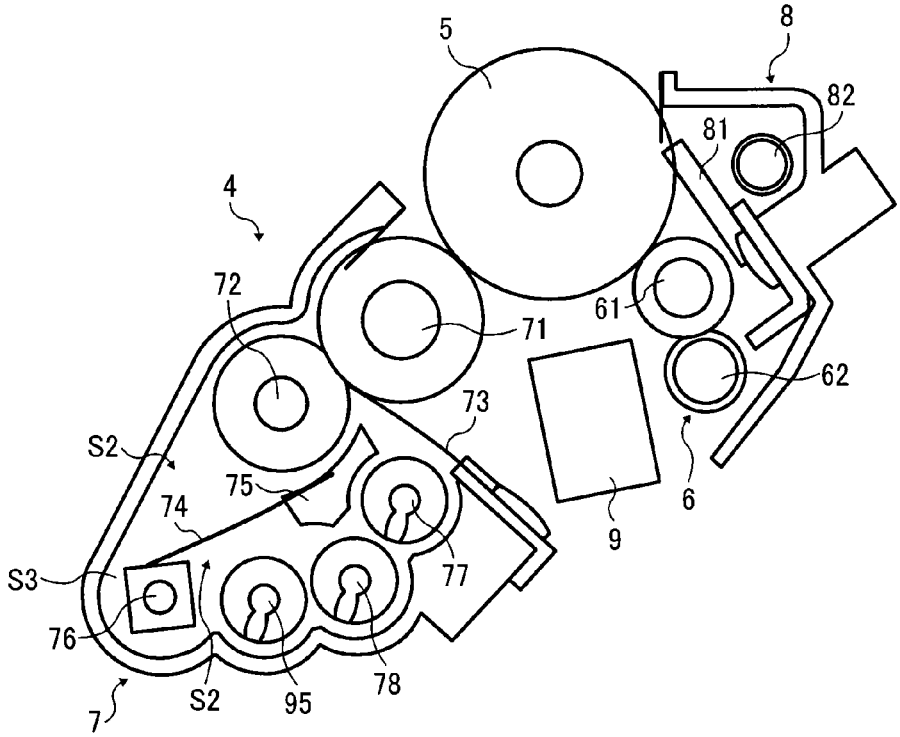
FIG. 9 is a cross-sectional view of the developing device according to another embodiment of the present invention perpendicular to the axial direction.
Figure 10:
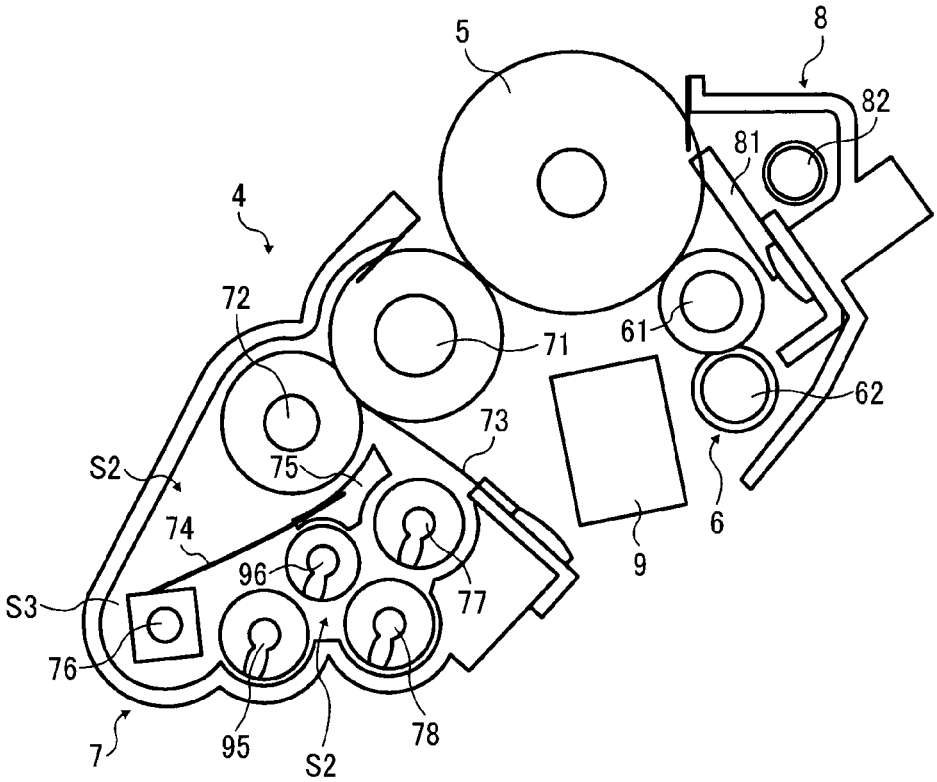
FIG. 10 is a cross-sectional view of the developing device according to another embodiment of the present invention perpendicular to the axial direction.

In this embodiment, two conveyers (i.e., the first conveyance screw 77 and second conveyance screw 78) are provided in the mixing chamber S1. However, the number of the conveyers is not limited to two. For example, as illustrated in FIG. 9, it is possible to provide three conveyance screws 77, 78, and 95. In this case, it is preferable that each of the conveyers have a conveyance direction different from each other. Alternatively, as illustrated in FIG. 10, it is possible to provide four conveyance screws 77, 78, 95, and 96.

An image forming apparatus for installing the developing device according to an embodiment of the invention is not limited to the printer illustrated in FIG. 1 and may be any of copier, facsimile machine, and combined machine thereof.

What is claimed is:

1. A developing device, comprising:

a developer carrier to carry developer on its surface and to supply developer to a latent image carrier carrying a latent image;

a regulator to regulate the thickness of developer on the surface of the developer carrier;

a first developer storing chamber to store developer separated from the developer carrier by the regulator and to be supplied with fresh developer;

a plurality of conveyers disposed within the first developer storing chamber, to convey developer in different conveyance directions;

a second developer storing chamber in communication with the first developer storing chamber, to be supplied with developer from the first developer storing chamber;

a supply member disposed within the second developer storing chamber, to supply developer to the developer carrier;

a divider to divide the first developer storing chamber from the second developer storing chamber; and a drawing member disposed within the first developer storing chamber to draw developer from the first developer storing chamber to the second developer storing chamber.

2. The developing device according to claim 1, further comprising a communication path communicating the lowermost part of the second developer storing chamber with the first developer storing chamber.

3. The developing device according to claim 2, wherein the drawing member draws the developer from the first developer storing chamber to the second developer storing chamber through the communication path.

4. The developing device according to claim 2, wherein the second developer storing chamber is configured such that a cross sectional area in a horizontal direction becomes gradually smaller downward.

5. The developing device according to claim 1, wherein the drawing member is rotatable and the divider is elastically deformed so as to constantly contact the drawing member while rotating.

6. The developing device according to claim 5, wherein the divider extends from below the supply member to contact the drawing member.

7. The developing device according to claim 5, wherein the divider extends obliquely downward to limit a cross sectional area in a horizontal direction of the second developer storing chamber to become gradually smaller downward.

8. The developing device according to claim 1, further comprising a developer detector disposed within the first developer storing chamber, to detect the amount of developer stored in the first developer storing chamber.

9. The developing device according to claim 1, wherein the plurality of conveyers include:

a first conveyer; and a second conveyer having a lower end that is positioned below a lower end of the first conveyer.

10. The developing device according to claim 9, wherein the second conveyer has a conveyance ability higher than that of the first conveyer.

11. The developing device according to claim 9, wherein the first conveyer is disposed below a regulating position of the regulator in a vertical direction.

12. The developing device according to claim 11, wherein the first conveyer forms a conveyance path supplied with the fresh developer.

13. The developing device according to claim 1, wherein the developer regulated by the regulator is circulated through the first developer storing chamber, the second developer storing chamber, the supply member, and the developer carrier, in this order, forming a first circulation path, wherein the developer stored in the first developer storing chamber is circulated within the first developer storing chamber, forming a second circulation path, and wherein the fresh developer is supplied to the second circulation path.

14. A process cartridge, comprising:

a latent image carrier; and the developing device according to claim 1.

15. An image forming apparatus, comprising:

a latent image carrier;

the developing device according to claim 1;

a transfer device to transfer a toner image onto a recording medium, the toner image being formed by developing the latent image by the developing device;

a fixing device to fix the toner image on the recording medium.

16. The developing device according to claim 1, wherein the drawing member has a convex polygonal cross-sectional shape.

* * * * *